US012709446B1

(12) United States Patent
Orr

(10) Patent No.: US 12,709,446 B1
(45) Date of Patent: Aug. 18, 2026

(54) BAG DISPENSER FOR ASEPTIC LIQUIDS

(71) Applicant: Timothy E. Orr, Redding, CA (US)

(72) Inventor: Timothy E. Orr, Redding, CA (US)

( * ) Notice: Subject to any disclaimer, the term of this patent is extended or adjusted under 35 U.S.C. 154(b) by 173 days.

(21) Appl. No.: 18/765,049

(22) Filed: Jul. 5, 2024

(51) Int. Cl.
*B65D 47/36* (2006.01)
*B65D 33/16* (2006.01)

(52) U.S. Cl.
CPC ..... *B65D 47/36* (2013.01); *B65D 33/16* (2013.01)

(58) Field of Classification Search
CPC ..... B65D 47/36; B65D 33/16
USPC ..... 222/81, 85, 478
See application file for complete search history.

(56) References Cited

U.S. PATENT DOCUMENTS 903,467 A * 11/1908 Glines ..... B65D 47/18 222/420
2,502,858 A * 4/1950 Klix ..... F16K 51/00 222/569
3,831,814 A * 8/1974 Butler ..... A61M 5/162 604/274
3,884,387 A * 5/1975 Vannucci ..... B67B 7/26 222/541.2
4,022,258 A * 5/1977 Steidley ..... B65D 47/10 141/330
4,325,496 A * 4/1982 Malpas ..... B65D 75/5877 222/90
4,440,316 A * 4/1984 Christine ..... B65D 75/5877 222/83.5
4,475,566 A * 10/1984 Haines ..... B67B 7/26 222/81
5,111,970 A * 5/1992 Rutter ..... B67D 3/047 222/105
5,114,033 A * 5/1992 Golias ..... B01L 3/0293 222/479
5,337,775 A * 8/1994 Lane ..... B67D 3/045 222/509
5,782,383 A * 7/1998 Robinson ..... A61J 1/1406 215/250
7,607,555 B2 * 10/2009 Smith ..... B65D 77/067 220/267
7,708,164 B2 * 5/2010 Pritchard ..... B65D 77/067 222/88
7,789,269 B2 * 9/2010 Pritchard ..... A47K 5/1208 222/541.9
9,604,836 B2 * 3/2017 Nini ..... B65D 47/38
9,862,533 B2 * 1/2018 Stever ..... B65D 77/067
10,280,062 B2 * 5/2019 Stever ..... B67B 7/24
2005/0263546 A1 * 12/2005 Labinski ..... F16K 24/02 222/478
2008/0142543 A1 * 6/2008 Jones ..... B67B 7/26 222/81
2008/0179273 A1 * 7/2008 Hidding ..... B65D 51/002 215/250

(Continued)

FOREIGN PATENT DOCUMENTS

WO WO-2008014605 A1 * 2/2008 ..... B65D 75/5877

*Primary Examiner* — Paul R Durand
*Assistant Examiner* — Michael J. Melaragno
(74) *Attorney, Agent, or Firm* — Theodore J. Bielen, Jr.

(57) ABSTRACT

A dispenser for aseptic fluids within a flexible bag utilizing a cap having first and second piercing members. An actuator moves one of the piercing members through a membrane found in a gland attached to the flexible bag while the other actuator is pushed through a membrane on the cap.

13 Claims, 7 Drawing Sheets

(56) References Cited

U.S. PATENT DOCUMENTS

| | | | | |
|---|---|---|---|---|
| 2008/0245816 | A1* | 10/2008 | Armstrong | B67B 7/24 222/518 |
| 2012/0211519 | A1* | 8/2012 | Hauner | B67D 3/045 222/81 |
| 2015/0096999 | A1* | 4/2015 | Nini | B67D 3/043 222/81 |
| 2015/0114993 | A1* | 4/2015 | Kerman | B65D 51/223 222/107 |
| 2017/0008685 | A1* | 1/2017 | Stever | B65D 77/067 |
| 2018/0111816 | A1* | 4/2018 | Stever | B65D 77/067 |
| 2022/0297901 | A1* | 9/2022 | Kieras | B65D 77/40 |

* cited by examiner

BAG DISPENSER FOR ASEPTIC LIQUIDS

BACKGROUND OF THE INVENTION

The present application relates to a novel and useful bag dispenser for aseptic liquids.

Aseptic processing of packages sterilizes liquid products and results in a shelf-stable entity that does not require refrigeration. For example, milk, fruit juices, cream, yogurt, salad dressings, liquid eggs, and the like are aseptically processed. Aseptic packaging normally consists of the steps of filling and sealing a sterilized container with a sterilized product. During this process, sterile conditions within the package, protection of the product from physical damage, and maintaining of the quality of the product is necessary.

Materials used in aseptic packaging include rigid paper, aluminum, and plastic. The latter material is normally a low-density polyethylene and is favored over metal or glass due to the relative cost of producing a plastic material. Also, plastic materials are lighter than metal or glass making the cheaper and easier to transport.

Once a plastic container or bag is filled with an aseptic liquid, easy and convenient dispensing of the liquid has proved to be a problem. For example, the emptying or dispensing of the aseptic liquid from a plastic bag container has entailed the placement of a second fitment to the bag or simply cutting or severing the bag to allow the liquid to egress therefrom.

Reference is made to U.S. Pat. No. 4,805,378 which depicts a method and system for filling flexible aseptic containers in which a double membrane is employed to cover the inlet to the flexible container.

In the past, devices have been proposed to penetrate or puncture seals to flexible containers holding aseptic liquids. For example, U.S. Pat. No. 7,591,398 teaches a container closure assembly that utilizes a cap having a puncture mechanism that is actuated by turning of the cap.

U.S. Pat. Nos. 4,779,764, 7,207,465, and 10,737,852 describe membrane breaking or tearing devices employed on a container and that include the provision of the construction of an external threaded structure connected to the fitment of the container. The puncture structure is actuated by the turning of the threaded member via a cap or other item.

U.S. Pat. No. 5,482,176 illustrates a membrane piercing closure spout assembly usable on a box-like container. The spout of the container is specifically structured with an external threaded surface that interacts with a piercing assembly, actuated by the counterclockwise rotation of a cap which possesses another threaded surface.

U.S. Pat. No. 8,151,985 shows a container having adjacent chambers each holding different substances. A seal element is placed within the container between the two chambers and includes an internal thread. The internal seal mates with the threaded surface of one chamber such that a cutting edge punctures a bottom seal upon rotation of the upper chamber portion relative to the bottom chamber. When the seal is broken substances in the first and second chambers are allowed to mix.

There is a need for a dispensing device which allows the recovery of aseptic fluid from a flexible plastic container without the need for alteration of the plastic container itself.

SUMMARY OF THE INVENTION

In accordance with the present application, a novel and useful dispenser device for removing liquid from a bag container chamber is herein provided.

The dispenser includes a cap having a surface plate with first and second apertures thereacross. The cap is also structured with a wall depending from the surface plate. A first membrane is also formed to seal or occult the first aperture through the surface plate of the cap.

A first piercing member extends through the second aperture across the surface plate. The first piercing member further includes a first passageway to allow travel therethrough of liquid from the bag container.

An actuator motivates the first piercing member along the second aperture. The actuator may take the form of a resilient member linked to the first piercing member such that the resilient member, having a spring function, is movable in a first direction and in an opposite second direction. Movement in the first direction is achieved by an application of pressure upon the resilient member, while movement in the second opposite direction is achieved by release of pressure upon the resilient member.

A case is also provided which comprises a channel adjacent the surface plate and the first piercing member. The channel includes an entrance adjacent the first piercing member and an exit apart from the entrance. The channel communicates with the first passageway of the first piercing member.

A novel gland is also included in the dispenser device of the present application. Such gland is affixed to the bag container and is formed with a spout having an opening therethrough communicating with the chamber of the bag container. The spout further includes an interior surface and an exterior surface. A sealing ridge is formed on the exterior surface of the gland. When the cap overlies the exterior surface of the gland, the ridge of the gland sealingly contacts the wall of the cap. The gland further is formed with a second membrane which covers or occults the opening through the spout. The first piercing member is adapted to perforate the second membrane over the spout upon extension through the second aperture across the surface plate of the cap. Such penetration allows the flow of liquid from the chamber of the bag container through the first passageway of the first piercing member, and through the channel from its entrance to its exit.

The device also may be formed with an adaptor which possesses a second piercing member which extends through the first aperture of the surface plate and perforates the first membrane which occults such aperture. The adaptor may also extend through the second membrane occulting the opening of the spout of the gland. Thus, liquid from the bag chamber is allowed to travel through the second passageway of the second adaptor.

A valve may be employed to limit the flow of liquid between the first passageway of the first piercing member, as well as the channel of the case. Such valve may be linked to the actuator spring. In addition, a separate valve may be included with the adaptor to control the flow of liquid through the second passageway of the adaptor.

It may be apparent that a novel and useful dispenser device for removing liquid from a bag container chamber has been hereinabove described.

It is therefore an object of the present application to provide a dispenser device for removing liquid from a bag container chamber which is easily adaptable to a bag containing aseptic material.

Another object of the present application is to provide a dispenser device for removing liquid from a bag container chamber that obviates the need for severing of the bag or the application of additional fitments.

Another object of the present application is to provide a dispenser device for removing liquid from a bag container chamber which is able to dispense liquid from a tap pump out configuration.

Another object of the present application is to provide a dispenser device for removing liquid from a bag container chamber that is easily adaptable to a bag container for aseptic liquids utilizing a membrane seal.

Another object of the present application is to provide a dispenser device for removing liquid from a bag container chamber that employs a novel gland for the bag which eliminates product splash found in prior art friction fitting cap glands.

Yet another object of the present application is to provide a dispenser device for removing aseptic liquid from a bag container chamber that is compatible with non-refrigeration of the aseptic liquid and results in shelf stability.

Another object of the present application is to provide a dispenser device for removing aseptic liquid from a bag container having an efficient gland attached to the bag that avoids leak between the gland and the dispenser when in use.

The application possesses other objects and advantages especially as concerns particular characteristics and features thereof which will be revealed as the specification continues.

For a better understanding of the application, reference is made to the following detailed description of the preferred embodiments thereof which should be taken in conjunction with the prior described drawings.

DETAILED DESCRIPTION OF THE PREFERRED EMBODIMENTS

Various aspects of the present application will evolve from the following description which should be taken with the prior delineated drawings.

Figure 1:
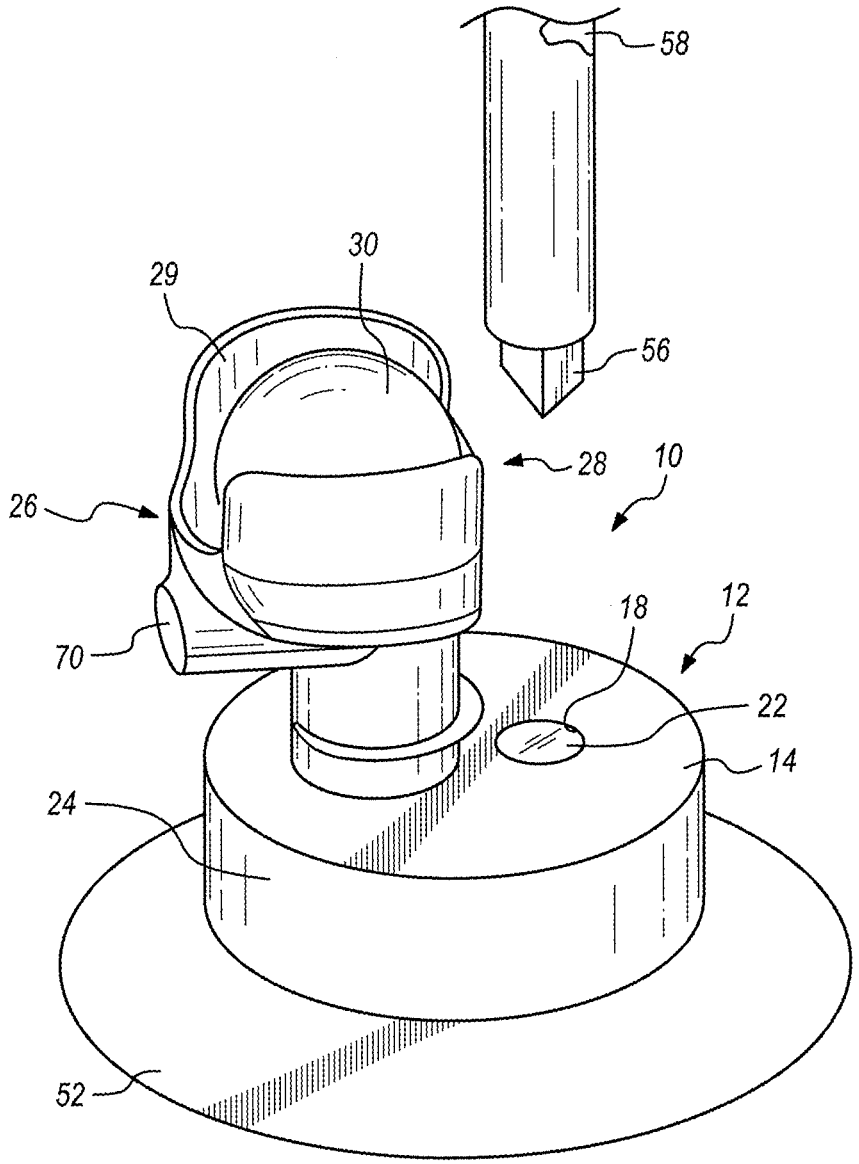
FIG. 1 is a isometric view of the dispenser device of the present application.
Figure 2:
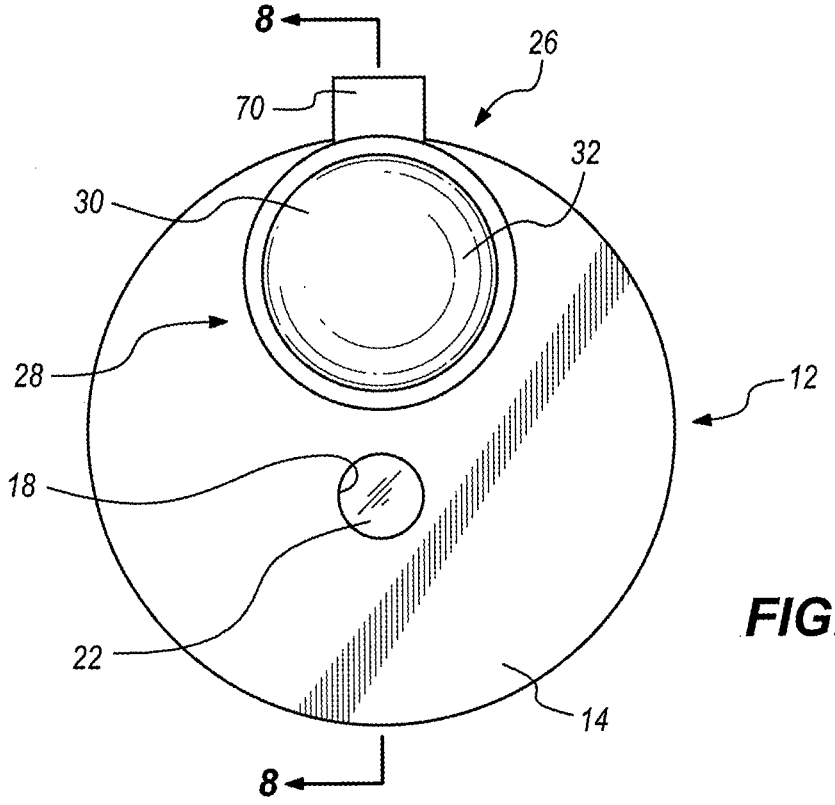
FIG. 2 is a top plan view of the device of FIG. 1.
Figure 3:
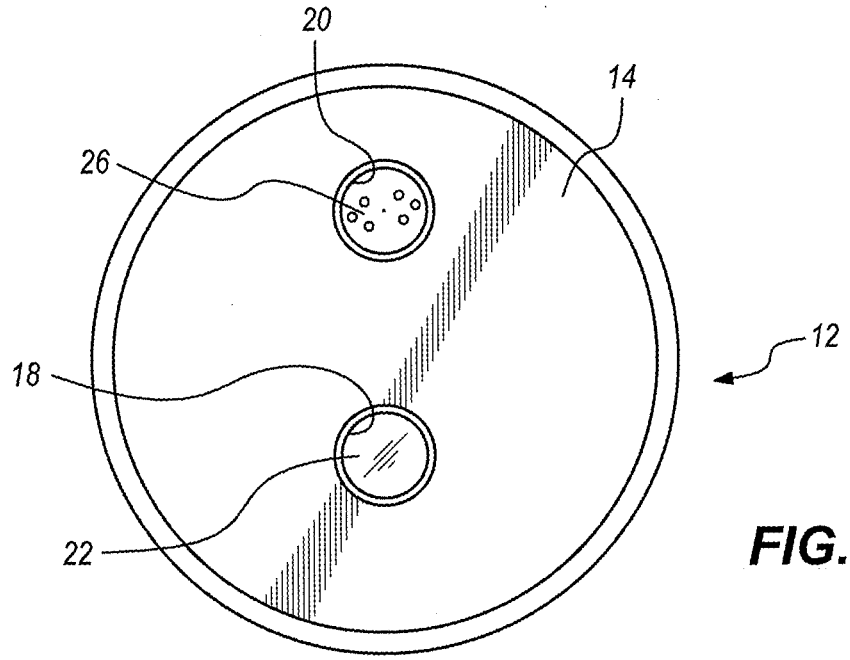
FIG. 3 is a bottom plan view of the device depicted in FIG. 1.

The application for a dispenser device is shown in whole by reference character 10. Dispenser device 10 includes as one of its elements a cap having a surface plate 14. First aperture 18 and second aperture 20 span across surface plate 14, FIGS. 1 and 2. A first membrane 22 covers or occults first aperture. Cap 14 is further constructed with a cylindrical-shaped wall which depends from surface plate 14. Device 10 is also provided with a first piercing member 26 which is extendable through a second aperture 20 across plate 14. The details of first piercing member 26 will be further elaborated as the specification continues.

An actuator 28 motivates first piercing member 26 downwardly through second aperture 20. The actuator 28 is formed with a resilient member 30. Resilient member 30 serves as a spring 32 to allow actuator 30 to return to a rest position from an extended position when motivating first piercing member 26, which will be discussed hereinafter as the specification continues.

Figure 4:
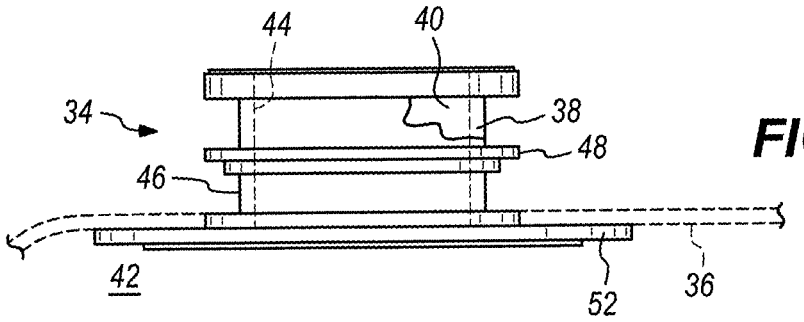
FIG. 4 is a side elevational view of a gland for a flexible container which is part of the device of the present application.
Figure 5:
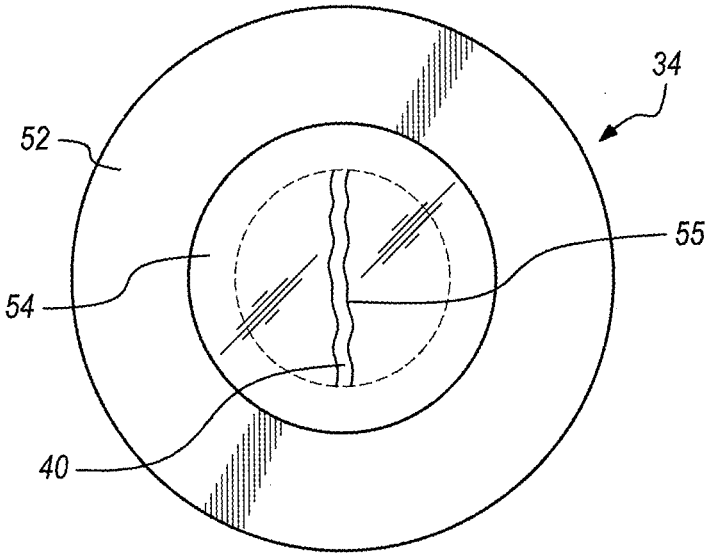
FIG. 5 is atop plan view of the gland depicted in FIG. 4.
Figure 6:
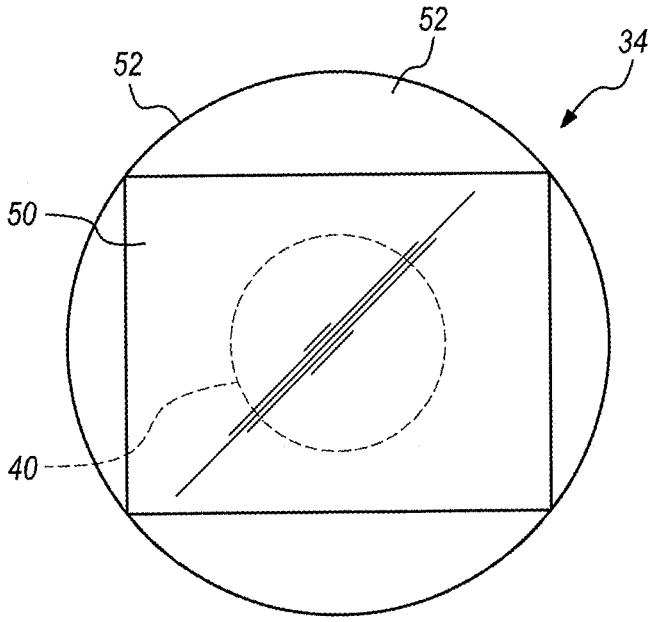
FIG. 6 is a bottom plan view of the gland depicted in FIG. 4.

Device 10 is also provided with a gland 34, FIGS. 4-6 that is attached to a flexible bag container 36. Reference is again made to U.S. Pat. No. 4,805,378 which indicates a system for aseptic filling of a container utilizing a double membrane system. Gland 34 is constructed with a spout 38 having an opening 40 therethrough. Opening 40 communicates with the chamber 42 of bag container 36 shown in phantom on FIGS. 4 and 7. Spout 38 further is shown with an interior surface 44 and an exterior surface 46. Gland spout 38 is further constructed with a ridge 48 on exterior surface 46. When cap 12 overlies exterior surface 46 of gland 34, ridge 48 sealingly contacts depending circular wall 24 of cap 12, which will be described in greater detail as the specification continues. Gland 34 is also provided with a second membrane 50 which convers or occults opening 40 through spout 38. Membrane 50 lies across a bottom flange 52 of gland 34, FIG. 6. With reference to FIG. 5, it should be realized that another membrane 54 is depicted across gland 34 and is shown as being perforated by perforating lines 55 as a result of the filling process of bag 36. Again reference is made to U.S. Pat. No. 4,805,378. In other words, after the filling process of bag 36, only first membrane 22 of cap 12 and second membrane 50 across flange 52 of gland 34 remain intact. Needless to say, first piercing member 26 is intended to perforate second membrane 50 upon extension through second aperture of cap 12.

Figure 7:
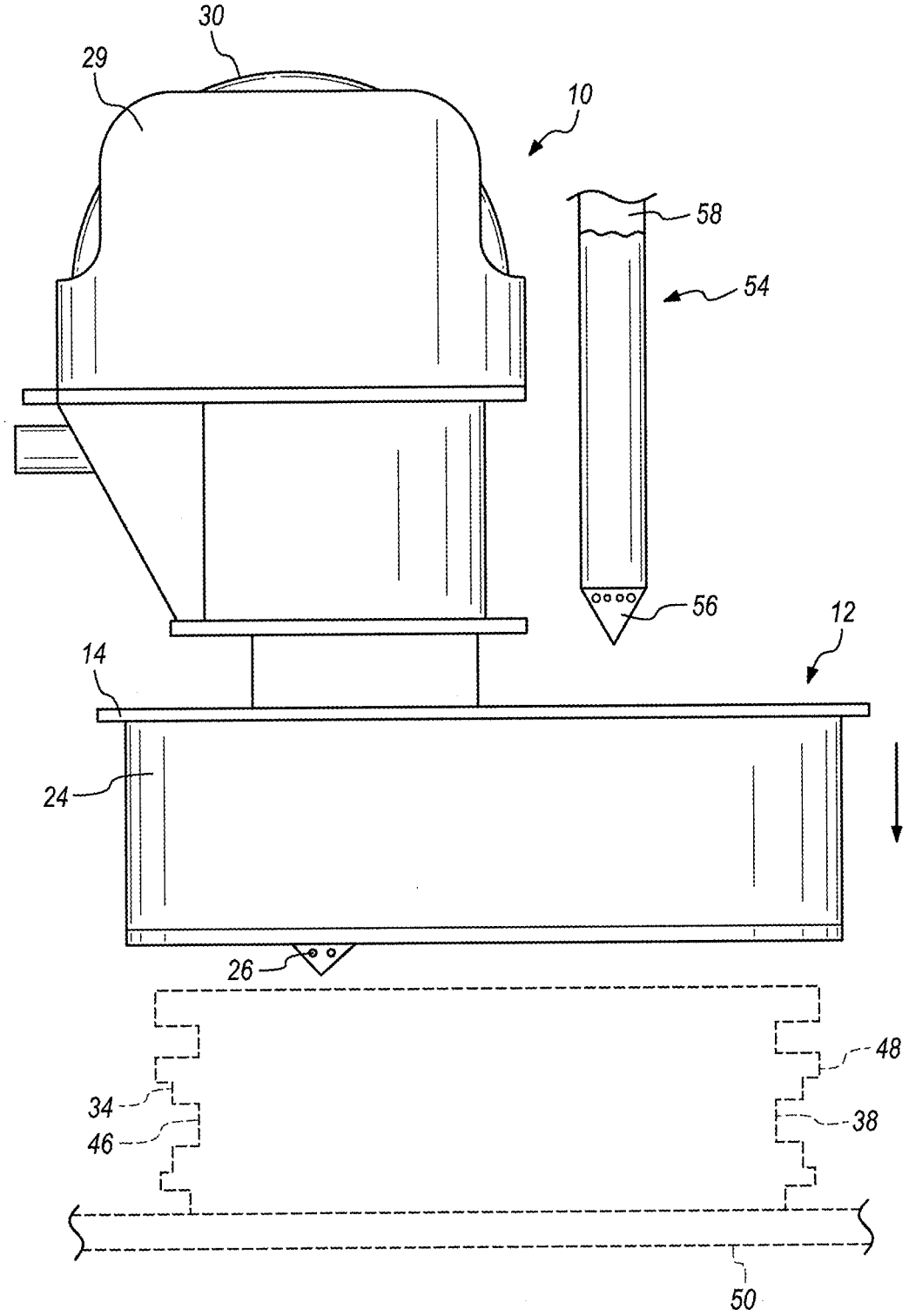
FIG. 7 is a side elevational view of the dispenser device of the present application with the gland depicted in phantom.
Figure 8:
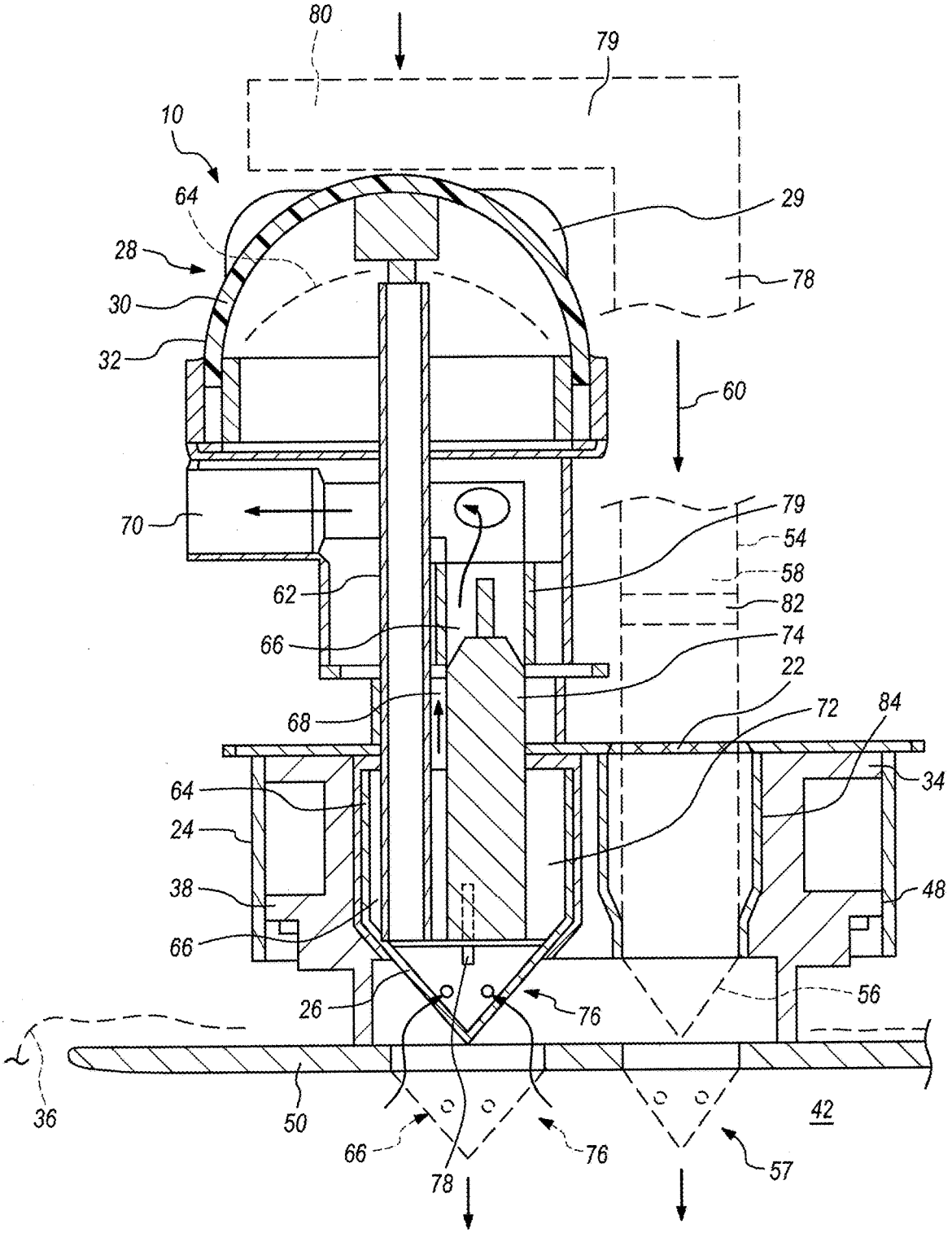
FIG. 8 is a sectional view taken along line 8-8 of FIG. 2.

Turning to FIGS. 7 and 8, it may be seen that the relationship between cap 12 and gland 34 is shown. In addition, an adaptor 54, such as a tap pumpout, serving as a second piercing member 56 is illustrated. Second piercing member 56 is intended to extend through second aperture 20 of surface plate 14 of cap 12 and to perforate first membrane 22. Adaptor 54 and second piercing member 56 is also able to extend through first aperture 18 and also pierce second membrane 50 of gland 34 if needed. Second piercing member 56 also possesses a passageway 58 to allow liquid to travel therethrough from bag container 36. FIG. 8 reveals in further detail the positioning and movement of first piercing member 26 and second piercing member 56. Directional arrow 60 indicates the movement of first piercing member 26 and second piercing member 56 toward and through membrane 50 of gland 34.

Again turning to FIG. 8, it may be seen that first piercing member 26 is provided with a connector 62 that attaches to resilient member 30 as well as to first piercing member 26 itself. Outline 64 represents the downward movement of resilient member 30 upon the application of pressure upon resilient member 30. Also, phantom line 66 shows the resultant movement of first piercing member 26 through membrane 50. Again, the spring 32 offered by resilient member 30 returns resilient upwardly when pressure is released. Device 10 is also provided with a case 64 having a channel 66 that has an entrance 68 adjacent first piercing member 26 and an exit 70 apart from entrance 68. Channel 66 communicates with a passageway 72 through first piercing member 26.

With further reference to FIG. 8, a valve 74 is utilized to limit the flow of liquid between first passageway 72 of first piercing member 26 and channel 66 of case 64. FIG. 8 shows valve 74 blocking the communication between first passageway 72 of first piercing member 26 and channel 66. Thus no flow extends through exit 70 of channel 66 at this point.

Figure 9:
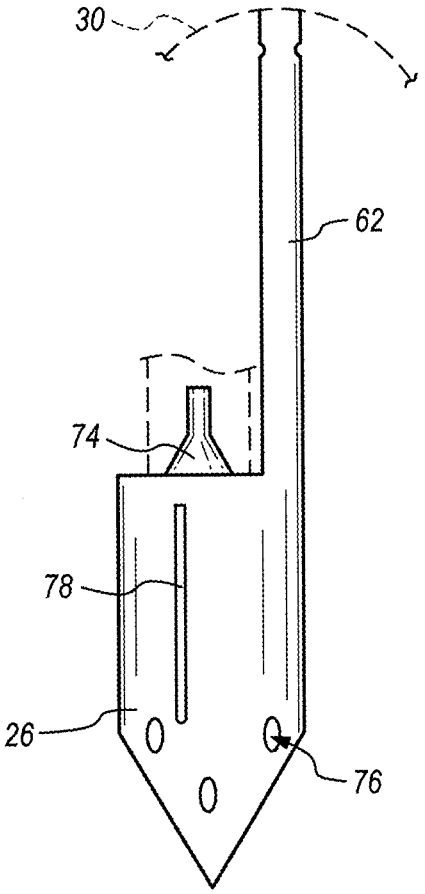
FIG. 9 is a schematic side elevational view of the first piercing member and valve depicted in FIG. 8.
Figure 10:
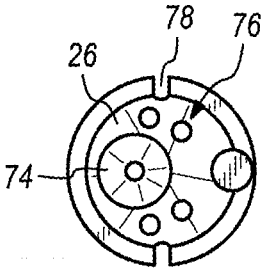
FIG. 10 is a top plan view of FIG. 9.

FIGS. 9 and 10 reveal valve 74 that acts in conjunction with a first piercing member 26 to achieve such valve control. Valve 74 is connected to first piercing member 26 and both operate in conjunction with the depression and release of resilient member 30 located between shroud 29. In other words, the depression of resilient member 30 opens valve 74 and the release of pressure on resilient member 30 closes valve 74 to prevent the transfer of liquid from chamber 42 of bag 36 following piercing of second membrane 50 of gland 34. It may also be seen from FIG. 9 that plurality of openings 76 and slot 78 through first piercing member 26 aids in the flow of liquid from chamber 42 of bag 36 to the exit 70 of channel 66. Likewise, openings 57 in second piercing member 56 allow the flow of liquid to passageway 58 of pumpout adaptor 54.

Moreover, adaptor 54 is shown, in FIGS. 7 and 8, as including a second piercing member 56 that penetrates first membrane 22 of surface plate 14 of cap 12 and may extend through second membrane 50 of gland 34. Second piercing member 56 may also pierce gland 50 if first piercing member 26 has not done so through the prior actuation of resilient member 30 heretofore described. Adaptor 54 is formed with a support 79 having a flange 80 that is extendable or pivotable over resilient member 30 to resist back pressure on resilient member 30 via connector 62. Adaptor 54 may also be provided with a valve 82 (in phantom) for regulating the flow of liquid from chamber 42 of bag 36 once first membrane 22 and second membrane 56 have been pierced by either first and second piercing members 26 and 56. Again, once membrane 50 has been pierced, the circular wall 24 of cap 12 fits snugly over gland 34 such that no liquid from bag 36 leaks or egresses from spout 38. Likewise, a cap seal 84 depending from surface plate 14 of cap 12 tightly seals the extension of second piercing member 56 through membrane 22. Again, in this case the only passage of liquid from chamber 42 of bag 36 would travel through passageway 58 of adaptor 54.

Figure 11:
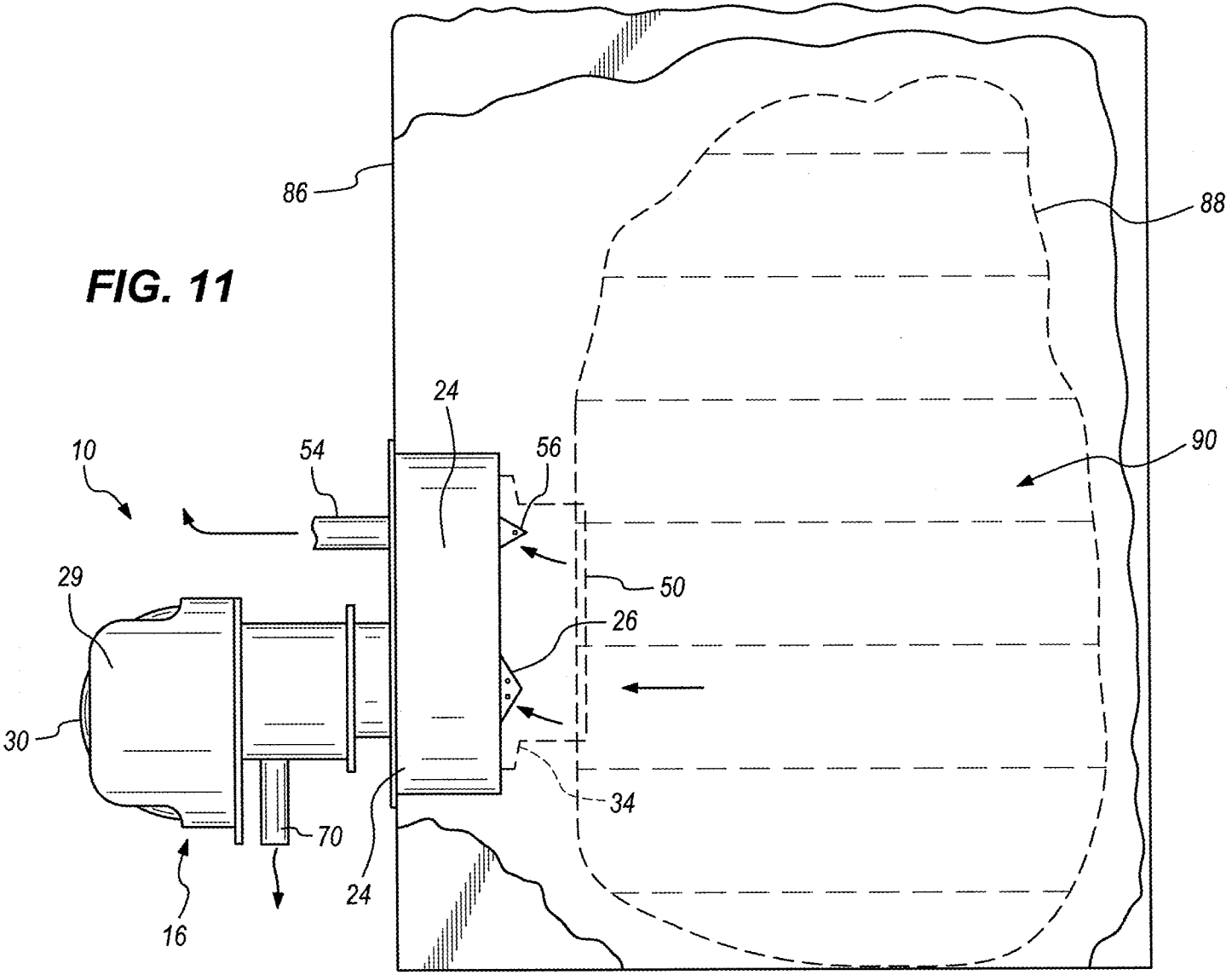
FIG. 11 is a side elevational view of the dispenser device of the present application mounted in a container.

FIG. 11 shows the mating of device 10 to a box 86 having a bag 88 therewithin. Bag 88 contains liquid 90 which may be an aseptic liquid. Directional arrow 92 represents the flow of liquid 90 through pierced membrane 50 and to first piercing member 26 and/or second piercing member 56, the construction of which is heretofore described.

In operation, the user utilizes device 10 by placing cap 12 over gland 34 which has been fastened to bag 36 containing liquid, which may be an aseptic liquid. Once attached, device 10 is able to utilize first piercing member 26 to perforate or break open second membrane 50 which forms a part of gland 34 attached to bag 36. First piercing member is extendable through second aperture 20 by actuator 28, specifically by the depression of resilient member 30 linked to connector 62 which is also fastened to first piercing member 26. Once first piercing member 26 extends into bag 36, liquid, such as aseptic liquid, may flow through openings 76 and slot 78, into the entrance 68 of channel 66, and through exit 70 thereof for use. Valve 74 attached to first piercing member 26 opens when such piercing member 26 is extended downwardly by actuator 28. However, the release of the spring 32 afforded by resilient member 30 allows valve 74 to interrupt the flow through channel 66 since the retraction of first piercing member 26 also actuates valve 74. Adaptor 54 may also be employed with device 10 by the use of second piercing member 56 of adaptor 54 which extends through first membrane 22 on surface plate 14 of cap 12. Second piercing member 56 may allow the flow of liquid from bag 36 through openings 57 of second piercing member 56. A support 79 for adaptor 54 may include a flange 80 that extends over resilient member 30 and serves to prevent further movement thereof due to liquid pressure exerted through connector 62. Device 10 may be fixed to a box 86 having a liquid filled bag therewithin, as shown in FIG. 11. The operation of device 10 through first and second piercing members 26 and 56, as heretofore described, allows liquid 90 to pass from bag 88 to exit 70 of device 10.

While in the foregoing, embodiments of the application 10 have been set forth in considerable detail for the purposes of making a complete disclosure of the application, it may be apparent to those of skill in the art that numerous changes may be made in such details without departing from the spirit and principles of the application.

What is claimed is:

1. A dispenser device for removing liquid from a bag container chamber, comprising:

a cap, said cap comprising a surface plate, said surface plate having first and second apertures thereacross and a first membrane occulting said first aperture, said cap further comprising a wall depending from said surface plate;

a first piercing member, said first piercing member being extendable through said second aperture across said surface plate, said piercing member further comprising a first passageway to allow travel therethrough of liquid from the bag container;

an actuator for motivating said first piercing member from a rest position to an extended position along said second aperture;

a case, said case comprising a portion of a channel adjacent said surface plate and said first piercing member, said channel further comprising an entrance adjacent said first piercing member and an exit apart from said entrance, said channel communicating with said first passageway of said first piercing member;

a gland affixed to the bag container, said gland formed with a spout having an opening therethrough communicating with the chamber of the bag container, said spout further including an interior surface and an exterior surface, said gland further comprising a ridge on said exterior surface, said cap overlying said exterior surface of said gland with said ridge of said gland sealingly contacting said wall of said cap, said gland further comprising a second membrane occulting said opening through said spout, said first piercing member perforating said second membrane upon extension through said second aperture across said surface plate of said cap; and an adaptor, said adaptor comprising a second piercing member being extendable through said second aperture of said surface plate and perforating said first membrane occulting said first aperture of said surface plate and being adapted for perforating said second membrane occulting said opening of said spout of said gland, said second piercing member further comprising a second passageway to allow travel therethrough of liquid from the bag container chamber.

2. The device of claim 1 in which said first piercing member passageway allows travel therethrough of liquid from the bag container chamber and said first piercing member further comprises apertures through said first piercing member.

3. The device of claim 1 which further comprises a spring for permitting a forward movement and return of said actuator from a rest position.

4. The device of claim 1 which further comprises a conduit connected to said second passageway of said second piercing member.

5. The device of claim 1 which further comprises a valve for limiting flow of liquid between first passageway of said first piercing member and said channel of said case, following piercing of said second membrane of said gland by said first piercing member.

6. The device of claim 5 in which said valve is connected to said actuator for motivating said first piercing member.

7. The device of claim 1 in which said actuator comprises a spring for returning said actuator from said extended position to said rest position.

8. The device of claim 7 in which said actuator spring comprises a resilient member linked to said first piercing member, wherein actuator spring comprises the resilient member movable in a first direction and an opposite second direction by the application and release of pressure thereupon, respectively.

9. The device of claim 7 in which said first piercing member passageway allows travel therethrough of liquid from the bag container chamber and said first piercing member further comprises apertures through said first piercing member.

10. The device of claim 7 which further comprises the spring for permitting a forward movement and return of said actuator from a rest position.

11. The device of claim 7 which further comprises a conduit connected to said passageway of said second piercing member.

12. The device of claim 7 which further comprises a valve for limiting flow of liquid between first passageway of said first piercing member and said channel of said case, following piercing of said second membrane of said gland by said first piercing member.

13. The device of claim 12 in which said valve is connected to said actuator for motivating said first piercing member.

* * * * *